US005101781A

United States Patent [19]

Wolfe

[11] Patent Number: 5,101,781

[45] Date of Patent: Apr. 7, 1992

[54] ELECTRONIC ENGINE PROTECTOR

[75] Inventor: Donald L. Wolfe, Wahoo, Nebr.

[73] Assignee: Paxton Mitchell Company, Omaha, Nebr.

[21] Appl. No.: 661,951

[22] Filed: Feb. 28, 1991

[51] Int. Cl.[5] ..... F02B 77/00

[52] U.S. Cl. ..... 123/198 D; 73/47

[58] Field of Search ..... 123/198 D, 198 DB; 73/47, 116, 717

[56] References Cited

U.S. PATENT DOCUMENTS

| | | | |
|---|---|---|---|
| 2,600,810 | 6/1952 | Lucas | 123/198 D |
| 4,653,445 | 3/1987 | Book et al. | 123/198 D |
| 4,719,792 | 1/1988 | Eriksson | 73/47 |

*Primary Examiner*—Noah P. Kamen
*Attorney, Agent, or Firm*—Henderson & Sturm

[57] ABSTRACT

An electronic engine protector including an electronic pressure transducer that produces variable voltage output in proportion to the differential pressure of the engine crankcase and the atmosphere. Circuitry is provided for selectively adjusting the pressure trip point which represents the faulted mode wherein the engine's fuel solenoid is turned off. Further, circuitry provides for a selectively adjustable time delay to prevent engine shut down due to momentary engine overloads, atmospheric phenomena, or other such temporary conditions that generate a false shut down signal.

5 Claims, 3 Drawing Sheets

ELECTRONIC ENGINE PROTECTOR

TECHNICAL FIELD

This invention relates to control devices for engines, and more particularly to engine protectors that detect higher than normal pressure in the crankcase, then shut down the engine before serious damage occurs.

BACKGROUND ART

Mechanical engine protectors are available which shut down a diesel engine when crankcase pressure reaches or exceeds a predetermined limit. The increased pressure is typically caused by scored liners, broken or badly worn pistons or rings, or other internal part failure. Such an engine protector is shown and described in U.S. Pat. No. 2,600,810 wherein the increased pressure acts to flex a diaphragm which operates a switch wired into the governor circuit to shut down the engine and activate a flashing red warning light. Although mechanical engine protectors are effective in detecting internal part failure before serious crankcase damage occurs, known protectors have some shortcomings.

When currently known engine protectors are used on locomotives "false" shut downs sometimes occur as the locomotive exits a tunnel. The train leaving a tunnel creates low pressure in the tunnel causing the protector diaphragm to flex and shut down the engine.

Those concerned with these and other problems recognize the need for an improved electronic engine protector.

DISCLOSURE OF THE INVENTION

The present invention provides an electronic engine protector including an electronic pressure transducer that produces variable voltage output in proportion to the differential pressure of the engine crankcase and the atmosphere. Circuitry is provided for selectively adjusting the pressure trip point which represents the faulted mode wherein the engine's fuel solenoid is turned off. Further, circuitry provides for a selectively adjustable time delay to prevent engine shut down due to momentary engine overloads, atmospheric phenomena, or other such temporary conditions that generate a false shut down signal.

An object of the present invention is the provision of an improved engine protector.

Another object is to provide an electronic engine protector.

A further object of the invention is the provision of an engine protector that has a time delay mechanism to prevent "false" shut downs.

Still another object is to provide an engine protector having a selectively adjustable time delay mechanism to allow for use in various applications.

A still further object of the present invention is the provision of an engine protector having selectively adjustable activation at various pressure differentials to allow for use on engines of various designs.

BRIEF DESCRIPTION OF THE DRAWINGS

These and other attributes of the invention will become more clear upon a thorough study of the following description of the best mode for carrying out the invention, particularly when reviewed in conjunction with the drawings, wherein.

BEST MODE FOR CARRYING OUT THE INVENTION

Figure 1:
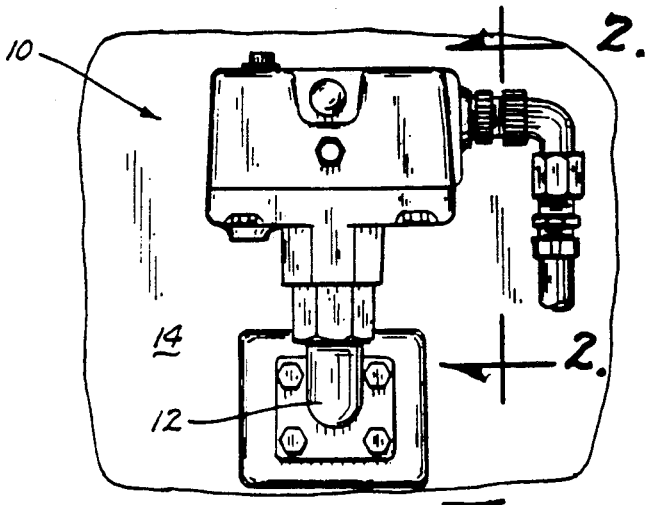
FIG. 1 is a perspective view showing the electronic engine protector of the present invention attached to a diesel engine in communication with the crankcase.
Figure 2:
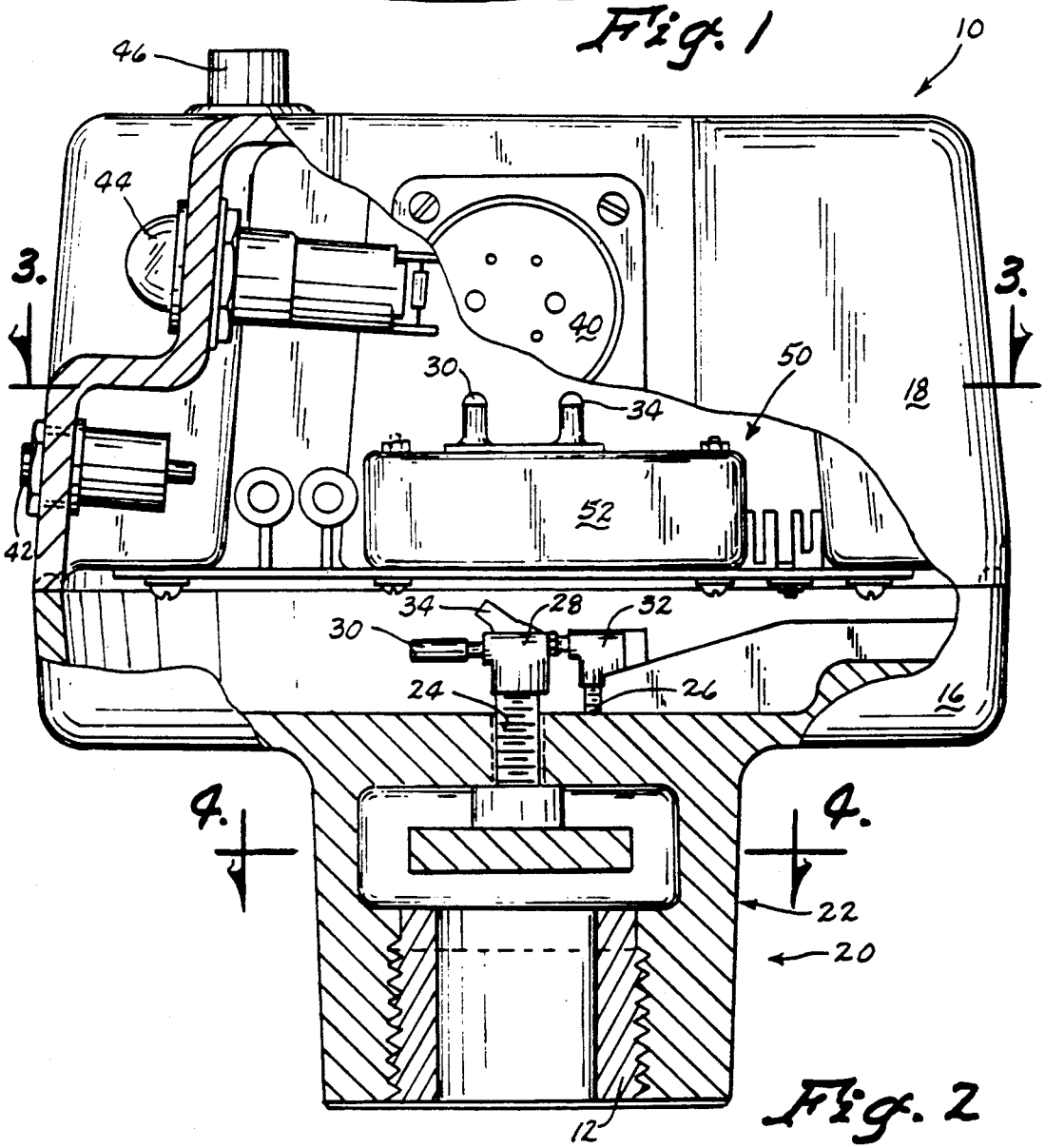
FIG. 2 is an enlarged side elevational view of the engine protector taken along line 2—2 of FIG. 1, with portions of the housing cut away to illustrate the position of the components, and the lower part of the base shown in section to illustrate the internal baffle.
Figure 3:
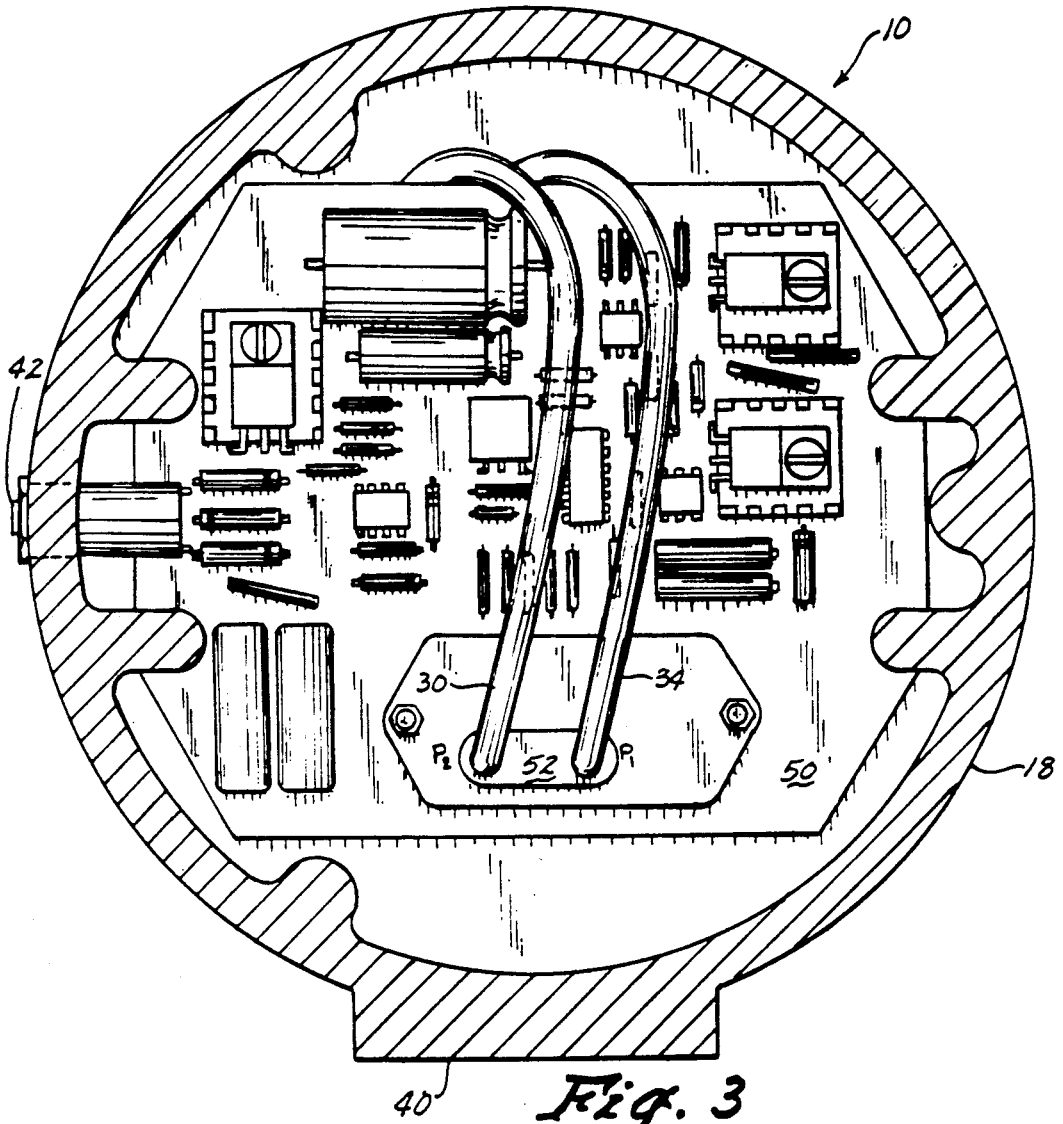
FIG. 3 is a top plan sectional view taken along line 3—3 of FIG. 2.

Referring now to the drawings, wherein like reference numerals designate identical or corresponding parts throughout the several views, FIG. 1 shows the engine protector (10) of the present invention attached to a fitting (12) extending from the crankcase of a diesel engine (14). As best shown in FIG. 2, the engine protector (10) has a housing formed of a base (16) and a dome (18) attached by conventional fasteners.

Figure 4:
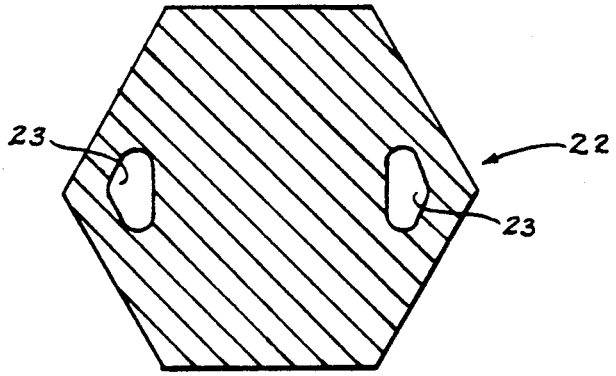
FIG. 4 is a sectional view taken along line 4—4 of FIG. 2.

The base (16) includes a threaded lower section (20) threadably attached to the fitting (12) and a baffle section (22) interposed between the fitting (12) and a central base opening (24). The baffle section (22) acts to prevent crankcase oil from entering the central base opening (24), while maintaining fluid communication through passages (23) (FIG. 4). A vent base opening (26) is offset from the central base opening (24). A fitting (28) interconnects the central opening (24) and a flexible conduit (30), and a fitting (32) interconnects the vent opening (26) with flexible vent conduit (34).

The exterior of the dome (18) carries an electrical connector (40), a reset button (42), a red warning light (44), and an amber indicator light (46). The interior of the dome (18) supports a circuit board (50) which includes a pressure transducer (52). The transducer (52) is attached to conduit (30) to sense the crankcase pressure, and is attached to conduit (34) to sense atmospheric pressure.

Figure 5:
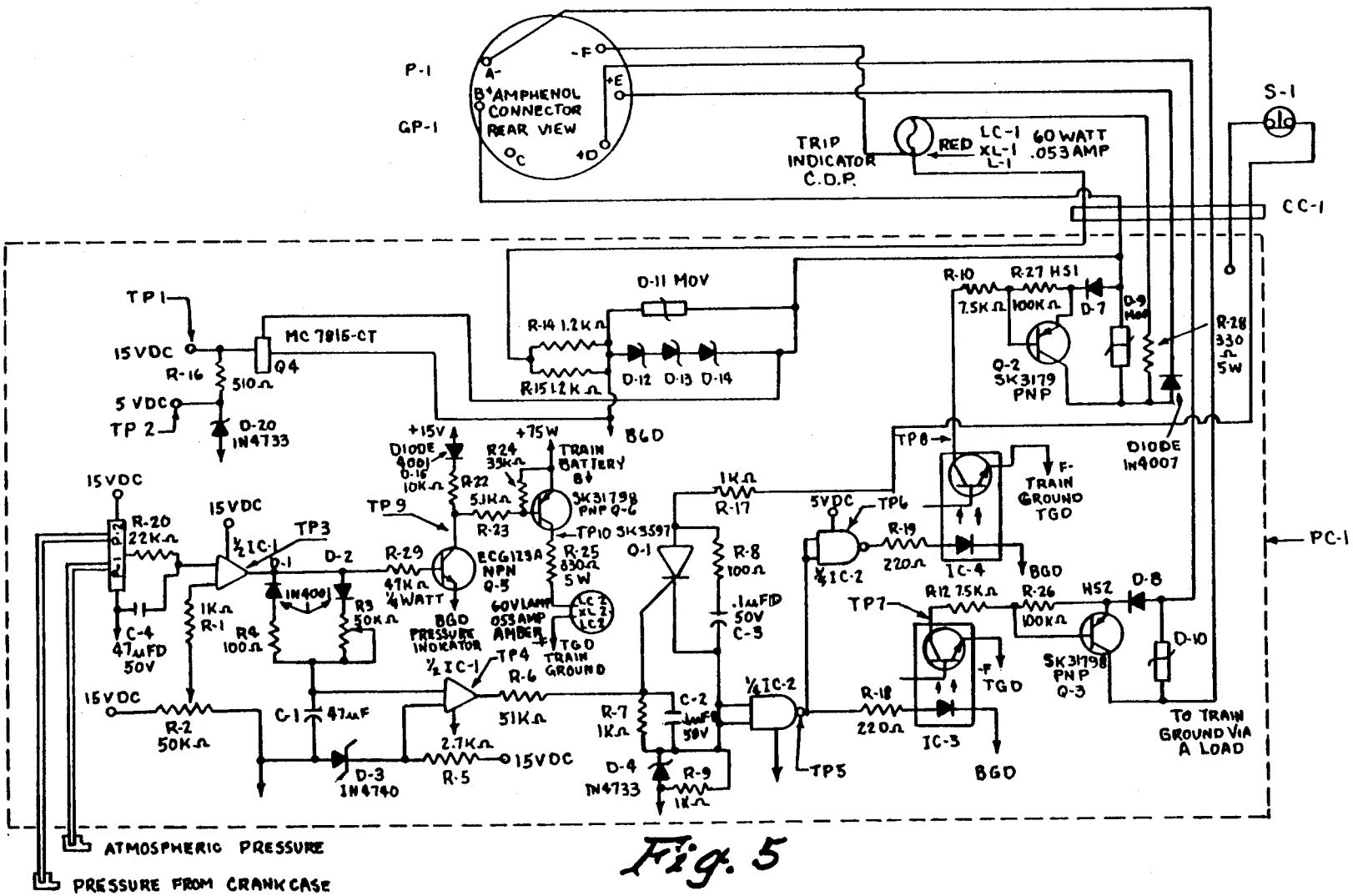
FIG. 5 is an electrical schematic showing the circuit which provides for selectively adjustable pressure limits and selectively adjustable time delay of the engine shut down.

The components and operation of the electronic engine protector (10) are best described by reference to FIG. 5.

POWER SUPPLY CIRCUIT OPERATION

A 15 volt and 5 volt source is generated from the 75 volt battery voltage of the train. This is done by dropping 21.5 volts through three diodes (7.5 volt Zeners D-12 through D-14) and passing the sufficient conduction current through R-14 and R-15 in parallel. This 21.5 volt unregulated voltage is applied to a 15 volt regulator Q-4, to produce a 15 volt regulated supply. In addition, a 5 volt Zener diode D-20 and R-16 form a 5 volt supply.

PRESSURE DETECTION

A pressure transducer produces a variable voltage output (0–15 volts) in proportion to differential pressure between P-1 and P-2 inputs, which are connected to atmospheric pressure and crankcase pressure, respectively. To eliminate possible mechanical resistive noise spikes, a low pass RC filter of 1 second formed by R-20 and C-4 precedes the transducer input to the comparator (made by op amp ½ IC-1A) at pin 3. The op-amp comparator will trip once the transducer voltage output exceeds the voltage set by the variable resistor R-2. This sets up the pressure trip point. It is to be understood that the pressure trip point may be selectively adjusted over a wide range. For example, the transducer shown in FIG. 5 provides for adjustment of the pressure trip point from 0 to 138.5" $H_2O$.

TIME DELAY

The output voltage of comparator (½ IC-1A) at pin 1 is either completely on or off. This provides a zero or +15 volt signal to the timing capacitor C-1. When pin 1 is high, the 47 UF capacitor C-1 charges up toward 75 volts through the steering diode D-2 and the timing resistor R-3. This timing resistor R-3 is variable to allow an adjustable time delay of nominal 1 to 10 seconds. This is the time for the capacitor C-1 to reach 10 volts to trip the comparator op-amp (½ IC-1B) at pin 5. The trip level is permanently set at 10 volts due to the Zener diode D-3 at input pin 6. It is to be understood that the time delay could be selectively adjusted over a wider range of times by use of components other than those illustrated in FIG. 5.

When output of comparator (½ IC-1A) at pin 1 goes to zero voltage, the diode D-1 allows conduction of current the other way to discharge the capacitor C-1 via R-4 at a fast rate (0.01 seconds). The action of all this is to allow the timing capacitor C-1 to charge up via D-2 at the R-3, C-1 timing constant rate (3 seconds); and to be discharged quickly through D-1 at a fast rate from R-4, C-1=0.01 seconds, when output of the comparator (½ IC-1A) at pin 1 goes to zero. This has the effect of keeping the second comparator (½ IC-1B) from tripping unless the pressure comparator (½ IC-1A) output remains high for longer than 3 seconds, thus eliminating shut down due to momentary engine overloads, atmospheric phenomena or other such false alarms.

LATCHING CIRCUIT

In order to lock the unit in the fault mode, a silicon controlled rectifier SCR Q-1 is used. Q-1 is triggered by the output of the timing comparator (½ IC-1B) at pin 7. When pin 7 is high, it allows SCRQ to conduct pulling input at pins 1 and 2 of NAND gate IC-2 high. The two NAND gates are wired to be two inverters in series. This provides the two opposite outputs at test points 5 and 6 to the drive load circuits. When one is on, the other is off.

The unit can only be reset by having the pressure transducer below the previous pressure trip point (2" $H_2O$), and pressing the reset button. Filter of noise spikes is accomplished by R-7, C-2 and R-8, C-3. The 5 volt Zener diode D-4 is used to limit input voltage to the NAND gate inverters IC-2.

OUTPUT CIRCUITS

The output of the NAND gate inverters IC-2 turn the opto-isolator IC-3 and IC-4 on/off. These are used because the board ground is at a different level than the train ground. The opto-isolators IC-3 and IC-4 turn the bases of the PNP power transistors Q-2 and Q-3 on and off. This allows battery voltage to be applied to the loads. When Q-2 and Q-3 are biased on, they are in a saturated mode.

In the normal mode, test point 5 is high, turning on the transistor in opto-isolator IC-3, which allows test point 7 to go to train ground. This low pulls the base of the output transistor Q-3 low and allows it to conduct from D+75 volt pin to A-load pin on the amphenol connector. At the same time, NAND gate output (¼ IC-2B) is low, keeping the opto-isolator IC-4 off. This allows TP8 at the base of Q-2 power transistor to stay high, keeping the voltage off between B+ and load.

In the normal mode Q-3 is on, allowing train voltage from pin D+ to connect to pin A- to provide voltage to the fuel solenoid to keep the train operating. In the faulted mode Q-3 is off, disconnecting current flow from D+ to A- pins, and turning off the fuel solenoid. Also, during the faulted mode Q-2 is on, allowing voltage from B+75 volt to light the red indicator on the housing unit. The bulb is 55 volts with a 330 ohm current limit resistor, so light will be visible at low train battery voltage. M.O.V. D-9 and D-10 are used to absorb voltage spikes in output loads.

PRESSURE INDICATOR LIGHT CIRCUIT

When output of the comparator (½ IC-1A) at pin 1 is high, it turns on Q-5 and Q-6. This allows current flow through the clear or amber light LC-2 on top of the housing unit. This indicator light is instantaneous whenever the pressure exceeds the pressure trip point (2" $H_2O$). The diode D-15 on Q-5 is used to stop current flow feeding back from the 75 volt supply of Q-6.

When pin 1 (½ IC-1A) is low, Q-5 is off and the base of Q-6 will be pulled high through the 33K ohm resistor R-24 to +75 volts, thus keeping the PNP transistor Q-6 off and keeping the indicator light LC-2 off.

NORMAL MODE

A pressure differential less than the pressure trip point (2" $H_2O$) keeps output of the comparator (½ IC-1A) off. This keeps Q-5 and Q-6 off, as well as indicator light LC-2. The zero output of comparator (½ IC-1A) also keeps the timing comparator (½ IC-1B) and SCR Q-1 off. The NAND gate inverter IC-2A at test point 5 is high, keeping Q-3 on and voltage to the A- load, thus allowing fuel solenoid to be activated. The inverter NAND gate IC-2B at test point 6 is low, which keeps Q-2 off, thus no power to load E-.

FAULTED MODE

At a pressure differential at or above the pressure trip point (2" $H^2$ O), the output of the comparator (IC-1A) at pin 1 goes high; turning on Q-5 and Q-6 which activates the indicator light LC-2. If excess pressure persists for a predetermined time (3 seconds), the indicator light LC-1 will be activated by the comparator (½ IC-1B) which will trigger SCR Q-1. Even if the pressure drops below the pressure trip point (2" $H_2O$), the unit will remain in faulted mode. With the red indicator light LC-1 on, test point 6 is on allowing transistor Q-2 to conduct, keeping power to load E-. At the same time, test point 5 is low, shutting off Q-3 and thus stopping voltage to load A-, shutting off the engine. The unit can only be reset by having the pressure below the pressure trip point (2" $H^2O$) and pressing the reset button.

Thus, it can be seen that at least all of the stated objectives have been achieved.

Obviously, many modifications and variations of the present invention are possible in light of the above teachings. It is therefore to be understood that, within the scope of the appended claims, the invention may be practiced otherwise than as specifically described.

I claim:

1. An electronic engine protector, comprising:

an electronic pressure transducer having an atmospheric pressure input in communication with the atmosphere and an engine crankcase pressure input in communication with an engine crankcase, wherein the transducer produces a variable voltage output in proportion to the differential between atmospheric pressure and engine crankcase pressure; and means for shutting down an engine when the transducer voltage output exceeds a predetermined voltage representing a predetermined pressure differential trip point.

2. The electronic engine protector of claim 1, further including means for selectively adjusting the pressure differential trip point.

3. The electronic engine protector of claim 1, further including means for delaying engine shut down for a predetermined time after the pressure differential trip point is reached.

4. The electronic engine protector of claim 3 further including means for selectively adjusting the predetermined time.

5. The electronic engine protector of claim 1 further including a baffle disposed between the engine crankcase and the transducer engine crankcase pressure input.

* * * * *